US006405803B1

(12) United States Patent
Giroux et al.

(10) Patent No.: US 6,405,803 B1
(45) Date of Patent: Jun. 18, 2002

(54) DIFFERENTIAL FLOW CONTROL VALVE

(75) Inventors: Richard Lee Giroux, Katy; Corey E. Hoffman, Magnolia, both of TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/549,785

(22) Filed: Apr. 14, 2000

(51) Int. Cl.[7] ..... E21B 34/10

(52) U.S. Cl. ..... 166/374; 166/319; 166/321; 137/14; 137/509

(58) Field of Search ..... 166/319, 321, 166/332.1, 374, 386; 37/14, 509

(56) References Cited

U.S. PATENT DOCUMENTS

| | | | | |
|---|---|---|---|---|
| 3,045,759 A | | 7/1962 | Garrett et al. | |
| 3,294,174 A | * | 12/1966 | Vincent | 166/321 |
| 3,901,314 A | | 8/1975 | Nutter | 166/152 |
| 3,902,523 A | * | 9/1975 | Gaut | 166/321 X |
| 3,973,586 A | * | 8/1976 | Hill et al. | 166/321 X |
| 3,987,848 A | * | 10/1976 | Canterbury | 166/321 |
| 4,059,157 A | | 11/1977 | Crowe | 166/317 |
| 4,274,490 A | | 6/1981 | Huckaby | 166/325 |
| 4,391,328 A | * | 7/1983 | Aumann | 166/321 X |
| 4,527,629 A | * | 7/1985 | Whitley et al. | 166/321 |
| 5,063,976 A | * | 11/1991 | Oi et al. | 137/509 X |
| 5,271,428 A | * | 12/1993 | Dunn et al. | 137/509 |
| 5,419,365 A | * | 5/1995 | Jezek | 137/509 X |
| 5,443,124 A | * | 8/1995 | Wood et al. | 166/374 |

OTHER PUBLICATIONS

Petro–Tech Tools, Inc., "Differential Valve," Feb. 24, 1999, 1–5 pages.

Cardium Tool Services Inc., Technical Unit—Dimensional Data 'FCV' Fluid Control Valve, May 17, 1996, 2 pages.

PCT International Search Report from PCT/GB 01/01722, dated Aug. 21, 2001.

* cited by examiner

*Primary Examiner*—George Suchfield
(74) *Attorney, Agent, or Firm*—Moser, Patterson & Sheridan, L.L.P.

(57) ABSTRACT

A downhole differential flow control valve is provided that utilizes a differential pressure area having one pressure area on which the wellbore pressure acts and a second area different from the first area on which pressure in the tubing acts. The differential area reduces the load in which the spring is required to exert a closing force in the valve. Thus, a coil spring can be used to improve the closing speeds of the valve.

20 Claims, 4 Drawing Sheets

DIFFERENTIAL FLOW CONTROL VALVE

BACKGROUND OF THE INVENTION

1. Field of the Invention

The present invention relates to oil field downhole tools. Particularly, the invention relates to flow control valves used in tubulars in a wellbore.

2. Background of the Related Art

In the operation of oil and gas wells, it is often necessary to enter the wellbore to perform some downhole task. Tool retrieval, formation stimulation and wellbore clean out are all examples of tasks carried out in a live well to improve production or cure some problem in the wellbore. Typically, a tubular of some type is inserted into a wellbore lined with casing or is run in production tubing to perform these tasks. Because so many wells are located in remote locations, coil tubing is popular for these operations because of its low cost and ease of use compared to rigid tubulars.

Selectively pumping a pressurized liquid or gas into a live well presents some challenges regardless of the use of rigid or coil tubing. For example, most operations require the fluid to be pumped at a predetermined depth in order to effect the right portion of a formation or to clean the effected area of the wellbore. In order to maintain the liquid in the tubular until a predetermined time, a valve proximate the downhole end of the tubular string is necessary to prevent the fluid from escaping until the operation begins. Additionally, to prevent loss of pressure in the tubular, the valve must open and close rapidly. The rapidity of operation is especially critical when coil tubing is used, because the maintenance of pressure within the coil tubing is necessary to prevent the tubing from collapsing due to adjacent pressure in the wellbore.

FIG. 1 is an exemplary well 10 which could be the subject of a downhole cleaning, removal or formation perforation operation. Typically, the wellbore hole is cased with a casing 12 that is perforated to allow pressurized fluid to flow from the formation 18 into the wellbore 15. To seal the mouth of the well, a wellhead 20 is mounted at the upper end of the wellbore. The wellbore in FIG. 1 is shown with a string of coil tubing 14 inserted therein. As herein described, the tubing is typically filled with a liquid or gas, such as water, foam, nitrogen or even diesel fuel for performing various operations in the well, such as cleaning or stimulating the well.

The weight of the fluid in the tubular member 14 creates a hydrostatic pressure at any given depth in the tubular member. The hydrostatic pressure in the tubing at the top surface is approximately zero pounds per square inch (PSI) and increases with depth. For example, the hydrostatic pressure caused by the weight of the fluid in the tubing in a 10,000 feet deep well can be about 5,000 PSI. In many instances, the hydrostatic pressure at a lower zone 22 of the tubing is greater than the wellbore pressure at a similar depth in the wellbore zone 24. Thus, a flow control valve 16 is used to control or stop the flow of the fluid from the tubular member 14 into the wellbore 15.

Even though the hydrostatic pressure in the tubing can be greater than the wellbore pressure near the bottom of the well, the opposite effect may occur at the top of the well. If the wellbore pressure is high, for example, in a gas well, the wellbore pressure at the top of the well can be several thousand PSI above the relatively low hydrostatic pressure in the tubing at the top of the well. It is generally known to well operators that a wellbore pressure greater than about 1,500 PSI can crush some tubing customary used in well operations, such as coil tubing. Thus, operators will pressurize the tubing 14 with additional pressure by pumping into the coil tubing to overcome the greater wellbore pressure at the top of the wellbore. In some high differential pressure applications, fluid must be pumped continuously through the tubular to maintain a pressure at the top of the tubular and waste the fluid into the wellbore because of the inability of a valve to control the high differential pressures.

In other applications, such as in lower differential pressure applications, a flow control valve can be mounted to the end of the tubular to attempt to adjust for the differences between the downhole hydrostatic pressures and associated wellbore pressures. The valve allows the wellbore pressure to counteract the hydrostatic pressure in conjunction with an upwardly directed spring force. FIG. 2 is a schematic of one exemplary differential flow control valve. The valve 26 is disposed at the lower end of a tubing (not shown) and has an upper passageway 28 through which tubing fluid can flow. The lower passageway 29 of the valve 26 allows wellbore fluid at a wellbore pressure to enter the valve 26. A poppet 30 is disposed within the valve 26 and engages a seat 32. Belleville washers 34, acting as a disk shaped spring, are disposed below the poppet 30 to provide a sufficient upward bias to override the hydrostatic pressure in the passageway 28. When the sealing member is sealingly engaged with the seat 32, the two passageways are fluidly disconnected from each other. When the pressure is increased sufficiently to override the upward bias, the sealing member 30 separates from the seat 32 and the two passageways are in fluid communication. The valve 26 operates on differential pressures in that the wellbore pressure provides an upward force on the poppet in addition to the Belleville washers 34.

However, it has been discovered that while the Belleville washers can open quickly, the washers close slowly, i.e., operate with different opening and closing speeds, known as a hysteresis effect. Thus, the valve 26 can be opened to flow pumped fluid from the tubing 14 into the wellbore 15 (shown in FIG. 1), but is insufficient to quickly close the valve to retain pressure in the tubing once a pump has stopped pumping fluid into the tubing to allow the valve to close. Thus, the differential pressure at the upper portion of the tubing is not maintained and the tubing can be deformed or crushed when a high differential pressure exists between the inside of the tubing and the surrounding wellbore. Other manufacturers, such as Cardium Tool Services, use a coil spring in a hydrostatic valve, but enclose the coil spring in a sealed chamber that is not open to varying pressures and thus not a differential flow control valve. Such valves can collapse and seize when high differential pressures are encountered.

It would be desirable to use a coil spring in a differential flow control valve, which has less hysteresis effects and generally equal opening and closing speeds, but the required forces generated from a typical coil spring in the relatively small diameters of the valve are insufficient to simply replace the Belleville washers. Thus, the use of a coil spring is not practical in a typical differential flow control valve.

Thus, there exists a need for a differential flow control valve which is more responsive to hydrostatic pressures, especially in applications having a high hydrostatic pressure compared to a surrounding wellbore pressure.

SUMMARY OF THE INVENTION

A downhole differential flow control valve is provided that utilizes a differential pressure area having one pressure area on which the wellbore pressure acts and a second area different from the first area on which pressure in the tubing acts. The differential area reduces the load in which the spring is required to exert a closing force in the valve. Thus, a coil spring can be used to improve the closing speeds of the valve.

In one aspect, a valve is provided for use in a wellbore, the valve comprising a body, a piston disposed in the body for engaging a valve seat disposed in the body, a biasing member producing a spring force to urge the sealing end of the piston into engagement with the valve seat, whereby the valve opens when the second force exceeds a combination of the spring force and the effective force. In another aspect, a differential pressure control valve is provided for oil field applications, comprising a valve housing having a housing passageway, a valve seat coupled to the housing and having a seat passageway disposed therethrough, a sealing member at least partially disposed within the valve housing and selectively engagable with the valve seat, a bias cavity in fluid communication with the seat passageway; and a bias member coupled to the sealing member that biases the sealing member toward the valve seat. In another aspect, a method of actuating a differential flow control valve is provided, comprising allowing a sealing member to engage a seat on a first piston surface, allowing a first fluidic pressure to apply a first force on at least a first portion of the first piston surface while allowing the first fluidic pressure to apply a greater force on a second piston surface distal from the first piston surface, biasing the sealing member toward the seat with a bias member having a cavity in fluidic communication with the first fluidic pressure, and applying a second fluidic pressure to at least a second portion of the first piston surface to open the valve, wherein a cross sectional area of the second portion is greater than a cross sectional area of the first portion.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DESCRIPTION OF THE PREFERRED EMBODIMENT

Figure 3A:
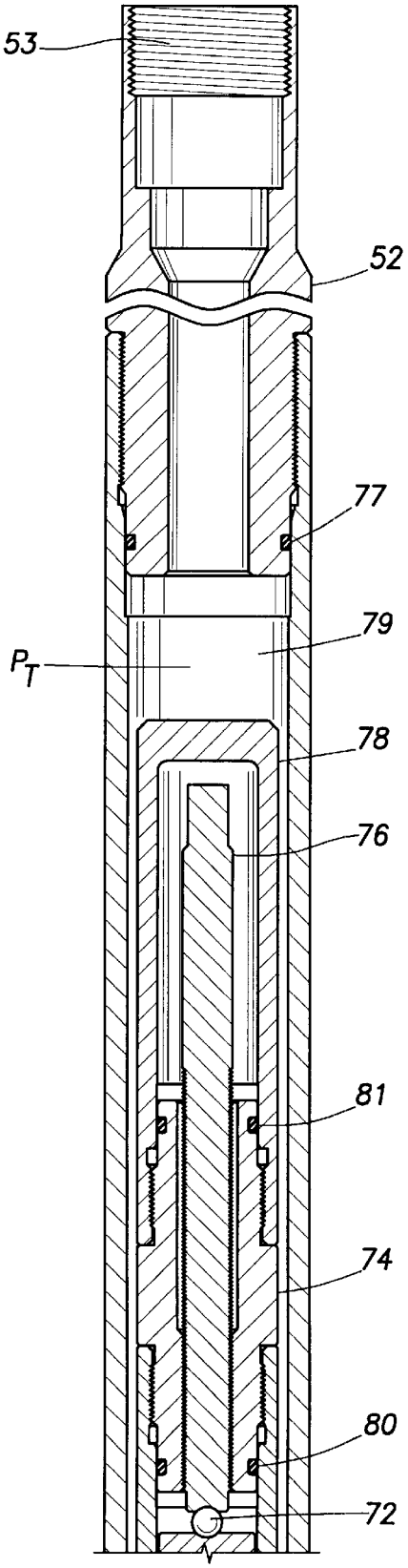
FIGS. 3A and 3B depict a schematic cross sectional view of a valve assembly.
Figure 3B:
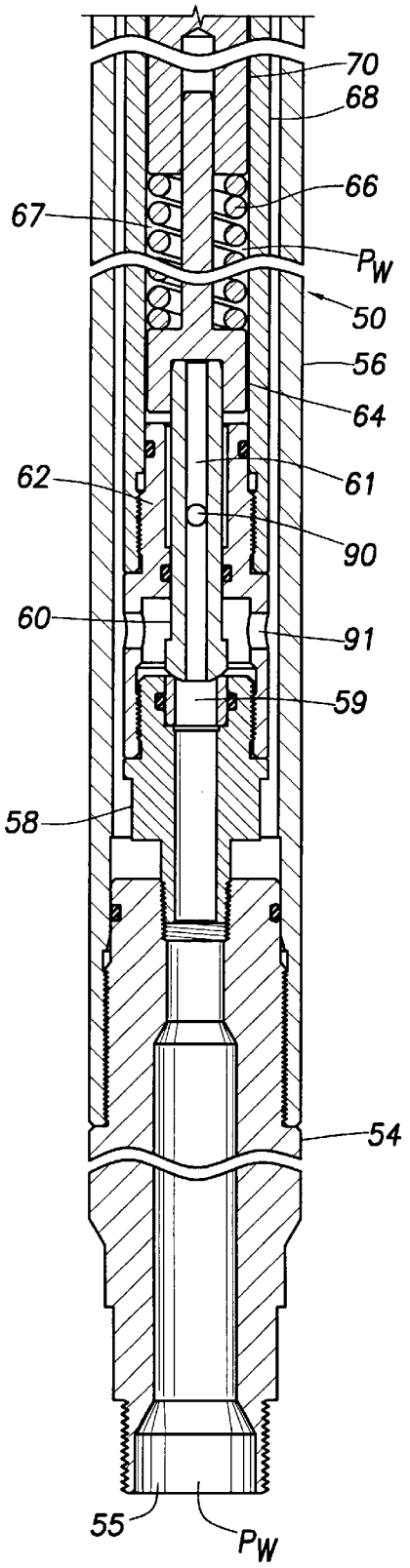

FIGS. 3A and 3B depict a cross sectional schematic view of one embodiment of the valve assembly 50. The assembly is shown with the upper end, as the valve would generally be positioned in a wellbore, on the left side of the figure. A top subassembly 52 is coupled to a housing enclosure 56 on an upper end of the valve assembly 50. A bottom subassembly 54 is coupled to the enclosure 56 on a lower end of the valve assembly 50. A seat assembly 58 is disposed between the subassemblies and internal to the enclosure 56. A sealing member, herein a "stem" 60, sealably engages the seat assembly 58. The seat assembly 58 includes a passageway 59, formed therethrough, in fluidic communication with a passageway through the bottom subassembly 54. Similarly, the stem 60 includes a passageway 61, formed therethrough, in fluidic communication with the passageway 59. A stem holder 62 is disposed circumferentially around the stem 60 where the stem is slidably and sealably engaged with the stem holder 62. A spring guide 64 is disposed above the stem holder 62 and surrounds a portion of the stem 60 on one end and has an elongated center rod disposed upwardly. A bias member, such as a coil spring 66, is disposed about the spring guide 64 in a spring cavity 67. A spring casing 68 surrounds the spring 66 and the spring guide 64 and is sealably engaged on a lower end to the stem holder 62. A spring holder 70 is disposed above the spring 66 and forms a bearing surface for an upper end of the spring 66. A roller ball 72 engages an upper end of the spring holder 70.

An adjustor sleeve is disposed above the roller ball 70, where the roller ball reduces friction between an adjustor sleeve 74 and the spring holder 70. The lower end of the adjustor sleeve 74 can also be threadably engaged with an upper end of the spring casing 68 and sealed thereto. An upper end of the adjustor sleeve 74 can be threadably engaged with a cap 78. The cap 78 forms a sealed cavity using seal 81 between the cap 78 and the adjustor sleeve 74. An adjustor 76 is disposed within the cap 78. The adjustor 76 has external threads which threadably engage internal threads of the adjustor sleeve 74. The adjustor 76 can be rotated so that the adjustor traverses longitudinally and applies a force to the spring 66 to vary the compression or expansion of the spring. A cavity 79 is formed above the cap 78 and is open in fluidic communication with the mouth 53 of the top subassembly 52.

Figure 1:
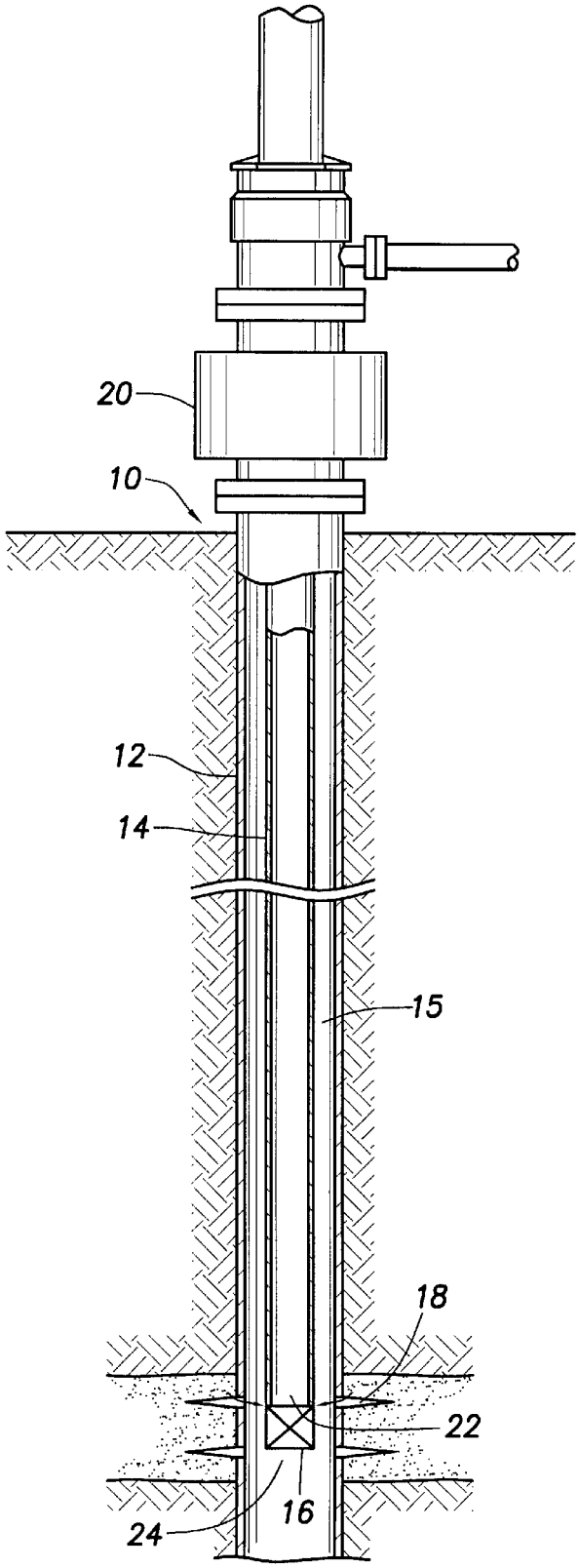
FIG. 1 (PRIOR ART)
FIG. 1 is a schematic of a well.
Figure 2:
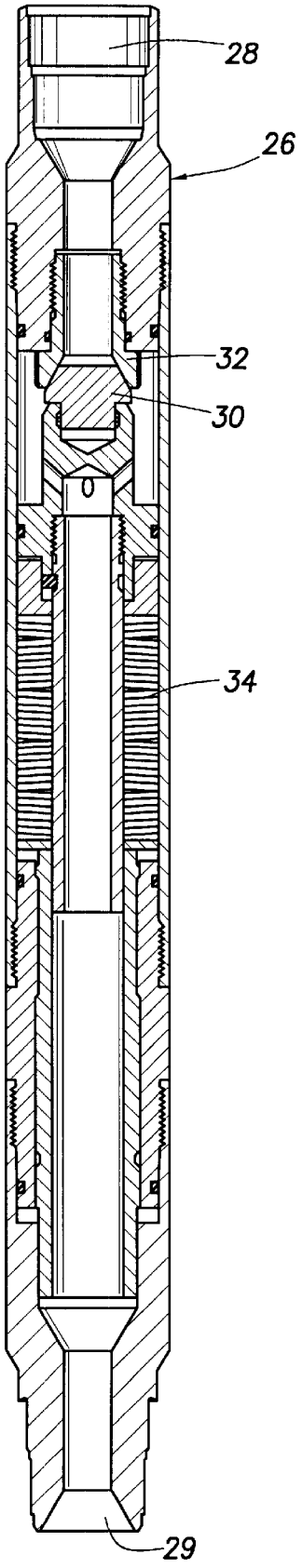
FIG.2 (PRIOR ART)
FIG. 2 is a schematic cross sectional view of an exemplary differential flow control valve.

A mouth 53 of the top subassembly 52 is fluidicly coupled to the inside of the tubing 14, shown in FIG. 1, to form a housing passageway therethrough. Thus, pressure existing in the tubing 14 (herein $P_T$) adjacent the valve assembly 50 can be transmitted through the mouth 53 through the top subassembly 52 into the chamber 79. The pressure can then be transmitted into an annulus formed between the inside diameter of the enclosure 56 and the outside diameters of the various components of the valve, including the cap 78, the adjustor sleeve 74 and the spring casing 68. The pressure $P_T$ then can exert a force on the stem 60 as disclosed in reference to FIGS. 4–5.

From the bottom of the valve, similarly the mouth 55 of the bottom subassembly 54 is in fluidic communication with the wellbore 15 (shown in FIG. 1) and the wellbore pressure (herein $P_W$) adjacent the valve assembly 50. The pressure in the wellbore $P_W$ is transmitted through the mouth 55 of the bottom subassembly 54 and through the passageway 59 in the seat assembly 58. The pressure Pw creates a force on the lower end of the stem 60. Further, the pressure $P_W$ is transmitted through the passageway 61 of the stem 60 and exerts a pressure on the top surface of the stem adjacent the spring guide 64.

A port 90 is disposed through the stem 60 and is fluidicly coupled to the passageway 61 of the stem 60, so that pressure $P_W$ is transmitted into and through port 90. Port 90 is fluidicly coupled to the spring cavity 67 by a space between the stem 60 and the stem holder 62 and by an annulus between the spring guide 64 and the spring casing 68. Thus, the spring cavity 67, the passageway 61 of the stem 60, the passageway 59 of the seat assembly 58, and the mouth of the bottom subassembly 54 are in fluidic communication to the pressure $P_W$ in the wellbore. The fluidic communication allows the valve assembly 50 to adjust to varying pressures in the wellbore at different depths and at different production pressures.

Figure 4:
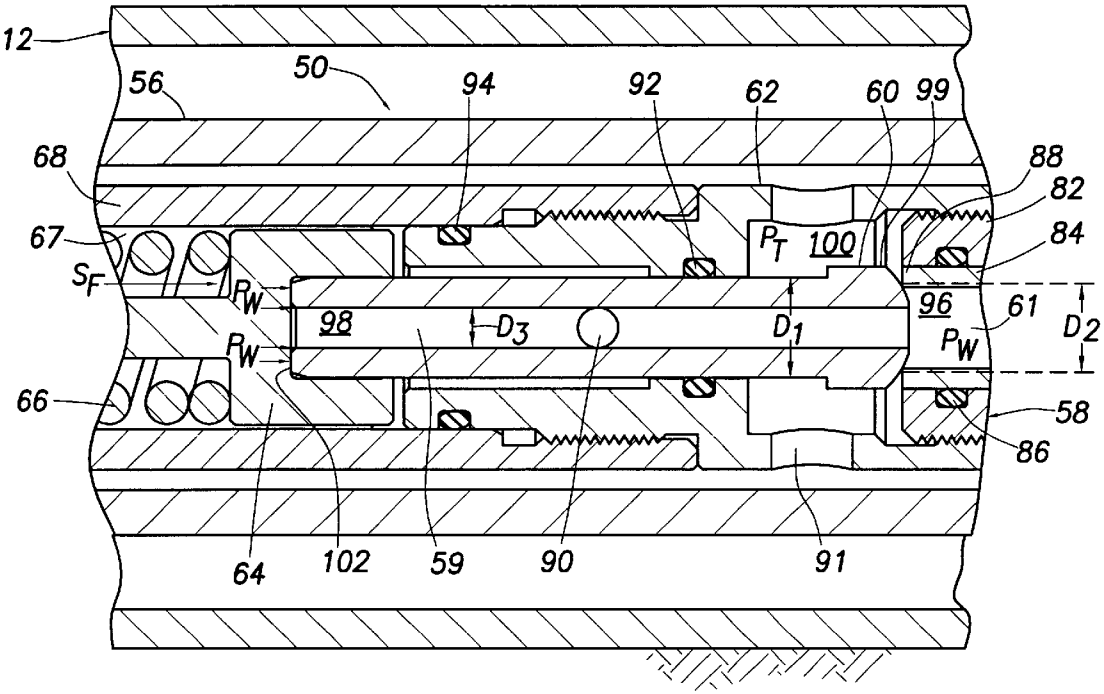
FIG. 4 is a detailed cross sectional schematic of a portion of the valve.

FIG. 4 is a detailed cross sectional schematic of the valve assembly 50. A bottom subassembly 54, shown in FIG. 3B, is coupled to a housing enclosure 56 and may be sealed thereto. A seat assembly 58 includes a seat support 82 and a replaceable seat 84. The seat assembly includes a passageway 59 formed herein. An annulus between the seat 84 and the seat support 82 may be sealed by seal 86. A stem 60 disposed above the seat 84 has a lower seating surface 88 that can contact an upper surface of the seat 84. A stem holder 62 circumferentially surrounds a portion of the stem 60 and may be slidably and sealably engaged to the stem with a seal 92. The stem holder 62 can be sealably engaged with a spring casing 68 using a seal 94. The housing enclosure 56 surrounds the stem 60, the stem holder 62 and spring casing 68, forming an annulus therebetween. The stem 60 includes a passageway 61 formed therein that is in fluid communication with the passageway 59 of the seat 84 and seat support 82 and the passageway through the bottom subassembly 54. Thus, the interior portions of the above mentioned members are in fluidic communication to the wellbore pressure $P_W$. A port 90 is disposed into the stem 60 and is in fluidic communication with the passageway 61 of the stem 60 and wellbore pressure $P_W$. The spring cavity 67 is in fluidic communication with the port 90 and allows wellbore pressure $P_W$ to be created therein. A spring guide 64 is disposed above the stem 60. A spring 66 is disposed adjacent the spring guide 64. Generally, spring 66 is a compression spring which exerts a downward force on the spring guide 64 and then to the stem 60. A spring casing 68 surrounds the spring 66, the spring guide 64 and the stem holder 62.

Tubing pressure zone 100 is fluidicly coupled to fluid in the tubing through port 91 and the associated pressure $P_T$. Pressure $P_T$ occurs through the top sub 53 shown in FIG. 3A and in the annulus between the enclosure 56 and the spring casing 68. At least a portion of the exterior surface 99 of the stem 60 is exposed to the tubing pressure $P_T$. When the stem 60 is lifted from the seat 84, fluid flow can occur through the tubing and into the wellbore zone 28, shown in FIG. 1. Lower wellbore pressure zone 96 and upper wellbore pressure zone 98 are fluidicly coupled to fluid in the wellbore and the associated wellbore pressure $P_W$.

It is believed that the wellbore pressure $P_W$ exerts an upward force on the stem 60 at the seating surface 88, acting as a piston surface, to a diameter $D_2$ approximately equal to one-half the distance between the outer and the inner diameters of the stem 60, shown as diameter $D_1$ and $D_3$, respectively. The upper portion 102 of the stem 60, also acting as a piston surface, has a larger diameter $D_1$ than the diameter $D_2$. Thus, the same pressure acting on the top of the stem 60 at diameter $D_1$ has a greater surface area compared to the area formed by diameter $D_2$ on which to act and creates a greater downhole effective force on the stem 60. The diameter $D_1$ is shown as a consistent diameter inside and outside of the stem holder 62. However, it is understood that the diameter could very such as a stepped diameter. Because the upper annular pressure zone 98 is exposed to the wellbore pressure $P_W$, and because the cross sectional area formed by diameter $D_1$ is larger than the cross sectional area formed by diameter $D_2$, the wellbore pressure $P_W$ acting on diameter $D_1$ overcomes the upward forces created by the pressure $P_W$ acting on the diameter $D_2$. Thus, the stem is pressurized to a closed position where the stem 60 engages the seat 84 at the seating surface 88. The spring 66 can also be used to supplement the downward force created by the wellbore pressure $P_W$ by applying a spring force $S_F$ to the spring guide 64 and then to the stem 60.

Similarly, the tubing pressure $P_T$ in the tubing pressure zone 100 acts on the outer circumference of the stem 60 between the seal 92 and the seating surface 88 to about the diameter $D_2$. The resultant force created by $P_T$ is an upwardly directed force acting on the difference in diameters between diameter$D_1$ and diameter $D_2$. In a closed valve position, the combination of the spring force $S_F$ and an effective force created by the wellbore pressure $P_W$ acting on the upper piston surface 102 of the stem 60 well forces the stem 60 into sealing engagement with the seat 84 at the seating surface 88. To open the valve, the tubing pressure $P_T$ can be increased, so that the upward force created by $P_T$ on the portion of the seating surface 88 between diameters $D_1$, and $D_2$ overrides the downward force created by the spring 66 and the wellbore pressure $P_W$ acting on the upper piston surface 102.

Figure 5:
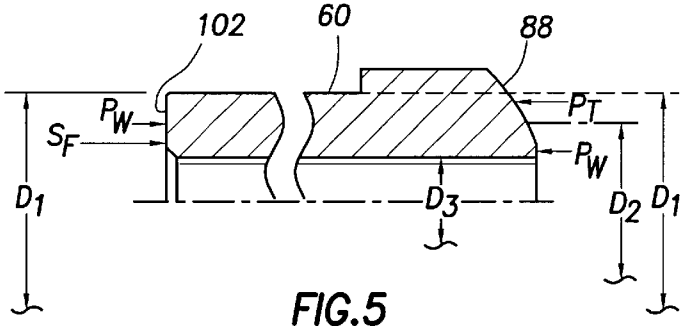
FIG. 5 is a cross sectional schematic of a force diagram.

FIG. 5 is a schematic force diagram of the forces acting on the stem 60. On the left portion of the figure, at an upper end of the stem 60, a spring force $S_F$ acts on the upper piston surface 102. Pressure $P_W$ creates a pressure force on the cross sectional area between diameters $D_1$ and $D_3$, where $D_3$ is the passageway 61 diameter of the stem 60. On the seating surface 88, $P_W$ creates a force on the cross sectional area between $D_2$ and $D_3$. Because pressure $P_W$ counteracts the forces created between diameters $D_2$ and $D_3$ on each end, a net effective downward force is created on the cross sectional area defined between$D_1$ and $D_2$ on the upper piston surface 102.

On the seating surface 88, the tubing pressure $P_T$ creates a net force resultant upward on the cross sectional area of the seating surface 88 defined between the diameter$D_1$ and $D_2$. A net closing force can be defined by the equation $F_C=P_W[(D_1/2)^2-(D_2/2)^2]\pi+S_F$, where $F_S$ equals a closing force and the other variables have been defined herein. A net opening force, in this example, directed upward toward the top of the wellbore would equal $F_O=P_T[(D_1/2)^2-(D_2/2)^2]\pi$, where $F_O$ equals the opening force. Thus, to close the valve, force $F_C$ is greater than force $F_O$ and, conversely, to open the valve, force $F_O$ is greater than force $F_C$. Generally diameter $D_1$ is greater than diameter $D_2$.

The ability to use a coil spring or other springs exerting a relatively small force is enabled by controlling the differential areas between diameters $D_1$ and $D_2$. The differential area can be defined as $[(D_1/2)^2-(D_2/2)^2]\pi$. For example, a relatively small differential area between diameters $D_1$ and $D_2$ results in compensating for a large difference between pressures $P_W$ and $P_T$. The difference in pressures is multiplied by a relatively small differential area and results in a relatively small difference in resultant forces. Thus, spring force $S_F$ may be relatively small to counteract relatively large pressure differences between the pressure $P_T$ in the tubing 14, shown in FIG. 1, and the pressure in the wellbore $P_W$. As merely one example, and others are available, if the $P_T$ equal 10,000 PSI, $P_W$ equals 5,000 PSI and the differential area between diameters $D_1$ and $D_2$ equals 0.1 square inches, then the resultant spring force $S_F$ required to override a 5,000 PSI difference in pressure would equate to merely 500 pounds. Similarly, with the same pressures, a differential area of 0.05 square inches would equate to a spring force of about 250 pounds to override the 5,000 PSI difference.

Other types of springs may be used and variations of the embodiments described herein are contemplated. For example, a gas spring can be used in addition to or in lieu of the coil spring. The gas spring can be a nitrogen filled cavity that exerts a downward force generally according to the formula PV=nRT for ideal gases where P is the pressure, T is the temperature, n is the number of moles, R is the universal gas constant and V is the volume. Thus, if downhole conditions are known, such as pressure and temperature, for a given volume, the gas spring can be precharged at a certain pressure and inserted downhole to a given position. The resultant effect is that the gas spring exerts a downward force on the stem 60 as described herein. In some embodiments, the gas charged cavity may operate in conjunction with a wellbore pressure $P_W$ so that the differential pressure is maintained.

While foregoing is directed to the preferred embodiment of the present invention, other and further embodiments of the invention may be devised without departing from the basic scope thereof, and the scope thereof is determined by the claims that follow. Further, the pressures described herein are approximate and have not been adjusted for friction losses. For example, the pressure in tubing $P_T$ may have some friction loss resulting in a smaller pressure after traversing the flow circuit in the valve. However, the principles of valve operation remain the same as described herein.

What is claimed is:

1. A valve for use in a wellbore, the valve comprising:

a) a body;

b) a piston disposed in the body for engaging a valve seat disposed in the body, the piston having:

i) a longitudinal piston bore allowing communication of a wellbore fluid through the piston;

ii) a sealing end having a first piston surface formed thereon for communication with a wellbore pressure to create a first force thereupon and a second piston surface formed thereon for communication with a tubing pressure to create a second force thereupon;

iii) a third piston surface formed on the piston for communication with the wellbore pressure to create a third force thereupon, the third force and the first force forming an effective force; and c) a biasing member producing a biasing force to urge the sealing end of the piston into engagement with the valve seat;

whereby the valve opens when the second force exceeds a combination of the biasing force and the effective force.

2. The valve of claim 1, wherein the biasing force is adjustable.

3. The valve of claim 1, wherein the first piston surface is an annular surface having an inside boundary coaxial with the outside boundary of the piston bore.

4. The valve of claim 3, wherein the second piston surface is an annular surface with an outside boundary coaxial with the outside diameter of the sealing end of the piston.

5. The valve of claim 1, wherein a surface area of the second piston area is greater than a surface area of the first piston area.

6. The valve of claim 1, further comprising a communication path external to the piston for a tubing fluid at least partially between the third piston surface and the first piston surface.

7. A differential pressure control valve for oil field applications, comprising:

a) a valve housing having a housing passageway;

b) a valve seat coupled to the housing and having a seat passageway disposed therethrough, the seat passageway being in selective communication with the housing passageway;

c) a sealing member at least partially disposed within the valve housing and selectively engagable with the valve seat, comprising:

i) a sealing member passageway disposed through the sealing member and in fluid communication with the seat passageway;

i) a first piston surface distal from the valve seat and having a first cross sectional area in fluid communication with the sealing member passageway wherein pressure within the sealing member passageway acts on at least a portion of the first cross sectional area;

ii) a second piston surface adjacent the valve seat and having a second cross sectional area wherein pressure within the seat passageway acts on at least a first portion of the second cross sectional area that is less than the first cross sectional area and wherein pressure within the housing passageway acts on a second portion of the second cross sectional area that is greater than the first portion of the cross sectional area;

d) a bias cavity in fluid communication with the second passageway; and e) a bias member coupled to the sealing member that biases the sealing member toward the valve seat.

8. The valve of claim 7, wherein the pressure within the housing passageway comprises tubing pressure.

9. The valve of claim 7, wherein the pressure in communication with the sealing member passageway of the sealing member comprises wellbore pressure and the pressure acts to bias the scaling member against the seat.

10. The valve of claim 7, wherein the bias member comprises a coil spring.

11. The valve of claim 7, wherein the valve housing is coupled to a tubing and inserted downhole in a wellbore and wherein the housing passageway is fluidicly coupled to a fluid passageway within the tubing and the seat passageway is fluidicly coupled to a wellbore.

12. The valve of claim 11, wherein the housing passageway is sealed from the bias cavity and the bias cavity is in fluid communication with the wellbore at a wellbore pressure.

13. The valve of claim 12, wherein the tubing has a tubing pressure adjacent the housing passageway and the wellbore has a wellbore pressure adjacent the seat passageway, wherein the difference in pressure between the tubing pressure and the wellbore pressure is at least about 5000 pounds per square inch (psi).

14. The valve of claim 7, further comprising an adjustor coupled to the bias member.

15. The valve of claim 7, further comprising a seat support coupled to the seat.

16. The valve of claim 7, further comprising a sealing member holder slidably and sealingly engaged with the sealing member wherein a first portion of the sealing member holder is in fluidic communication with the seat passageway.

17. The valve of claim 16, wherein a first portion of an external surface of the sealing member is in fluidic communication with the seat passageway and a second portion of the external surface of the sealing member is in fluidic communication with the housing passageway.

18. A method of actuating a differential flow control valve, comprising:

a) allowing a first piston surface of a sealing member to engage a seat;

b) allowing a first fluidic pressure to apply a first force on at least a first portion of the first piston surface while allowing the first fluidic pressure to apply a greater force on a second piston surface distal from the first piston surface;

c) biasing the sealing member toward the seat with a bias member, the bias member being in fluidic communication with the first fluidic pressure; and d) applying a second fluidic pressure to at least a second portion of the first piston surface to open the valve, wherein a cross sectional area of the second portion is greater than a cross sectional area of the first portion.

19. The method of claim 18, wherein the second force is in an opposite direction than the first force.

20. The method of claim 18, wherein biasing the sealing member comprises using a coil spring.

* * * * *